US010013964B1

(12) United States Patent
Tzirkel-Hancock et al.

(10) Patent No.: US 10,013,964 B1
(45) Date of Patent: Jul. 3, 2018

(54) METHOD AND SYSTEM FOR CONTROLLING NOISE ORIGINATING FROM A SOURCE EXTERNAL TO A VEHICLE

(71) Applicant: GM GLOBAL TECHNOLOGY OPERATIONS LLC, Detroit, MI (US)

(72) Inventors: Eli Tzirkel-Hancock, Ra'Anana (IL); Ilan Malka, Tel Aviv (IL); Scott M. Reilly, Southfield, MI (US); Frank C. Valeri, Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/682,756

(22) Filed: Aug. 22, 2017

(51) Int. Cl.
*G10K 11/178* (2006.01)
*H04R 5/02* (2006.01)

(52) U.S. Cl.
CPC ..... *G10K 11/178* (2013.01); *H04R 5/02* (2013.01); *G10K 2210/1282* (2013.01)

(58) Field of Classification Search
None
See application file for complete search history.

(56) References Cited

U.S. PATENT DOCUMENTS

| | | | | |
|---|---|---|---|---|
| 7,171,003 | B1 * | 1/2007 | Venkatesh | H03G 3/32 381/66 |
| 9,177,542 | B2 * | 11/2015 | Pan | G10K 11/1784 |
| 9,595,253 | B2 * | 3/2017 | Inoue | G10K 11/1786 |
| 9,773,495 | B2 * | 9/2017 | MacNeille | G10K 11/1786 |
| 2010/0296668 | A1 * | 11/2010 | Lee | G10K 11/1784 381/94.7 |
| 2012/0230504 | A1 * | 9/2012 | Kuroda | G10K 11/178 381/71.4 |
| 2015/0012267 | A1 * | 1/2015 | Rill | G10L 15/20 704/233 |

* cited by examiner

*Primary Examiner* — Paul Huber
(74) *Attorney, Agent, or Firm* — Cantor Colburn LLP

(57) ABSTRACT

A system and method for controlling noise originating from a source external to a vehicle is disclosed. The method includes determining, by an active noise controller of a vehicle, characteristics of an unwanted noise. The unwanted noise originates from a source external to the vehicle. The method also includes determining an inverted noise based on the characteristics of the unwanted noise. The method also includes projecting the inverted noise. The projected inverted noise destructively interferes with the unwanted noise. The method also includes receiving a residual noise via an error microphone. The error microphone is configured to generate a signal based on the received residual noise.

18 Claims, 4 Drawing Sheets

METHOD AND SYSTEM FOR CONTROLLING NOISE ORIGINATING FROM A SOURCE EXTERNAL TO A VEHICLE

INTRODUCTION

The subject embodiments relate to controlling unwanted noise that originates from a source external to a vehicle. Specifically, one or more embodiments can be directed to generating an inverted noise to reduce the unwanted noise, for example.

Drivers and/or passengers within a vehicle can hear unwanted noises within the vehicle cabin. Many of the unwanted noises can originate from sources outside of the vehicle. For example, other neighboring vehicles or neighboring machinery can cause unwanted sounds that are heard by drivers/passengers within the vehicle cabin.

Accordingly, it is desirable to provide active noise control to reduce an unwanted sound by adding a second sound that is configured to destructively interfere with the unwanted sound. When the unwanted sound is combined with the second sound, the two sounds can effectively cancel each other out.

SUMMARY

In one exemplary embodiment, a method includes determining, by an active noise controller of a vehicle, characteristics of an unwanted noise. The unwanted noise originates from a source external to the vehicle. The method also includes determining an inverted noise based on the characteristics of the unwanted noise. The method also includes projecting the inverted noise. The projected inverted noise destructively interferes with the unwanted noise. The method also includes receiving a residual noise via an error microphone. The error microphone is configured to generate a signal based on the received residual noise.

In another exemplary embodiment, the method also includes receiving vehicle-to-vehicle communication from a neighboring vehicle. The unwanted noise originates from the neighboring vehicle. The characteristics of the unwanted noise are determined based on the received vehicle-to-vehicle communication and based on the signal from the error microphone.

In another exemplary embodiment, the received vehicle-to-vehicle communication includes at least one of an engine revolutions-per-minute of the neighboring vehicle, a position of the neighboring vehicle, a velocity of the neighboring vehicle, and an identifier of the neighboring vehicle.

In another exemplary embodiment, the method also includes receiving laser-detection-and-ranging information, camera information, or radar information about a neighboring vehicle. The unwanted noise originates from the neighboring vehicle, and the characteristics of the unwanted noise are determined based on the signal from the error microphone and based on the received laser-detection-and-ranging information, camera information, or radar information.

In another exemplary embodiment, the determining the inverted noise includes determining a corresponding internal noise that results from the characteristics of the unwanted noise via a reference equalizer.

In another exemplary embodiment, the reference equalizer is configured to perform filtering to correct for a low-frequency transfer function between an external object and an internal reference point.

In another exemplary embodiment, the determining the inverted noise includes determining the inverted noise using a digital filter.

In another exemplary embodiment, the determining the inverted noise includes determining the inverted noise using an adaptive algorithm.

In another exemplary embodiment, the received vehicle-to-vehicle communication is input into a sync estimation processor, and the sync estimation processor is configured to generate a synchronization signal based on the received vehicle-to-vehicle communication. The received vehicle-to-vehicle communication is input into a reference equalizer.

In another exemplary embodiment, the signal of the error microphone is input into a sync estimation processor, and the sync estimation processor is configured to generate a synchronization signal based on the signal of the error microphone. The received laser-detection-and-ranging information, camera information, or radar information is input into a reference equalizer.

In another exemplary embodiment, a system within a vehicle includes an electronic controller. The electronic controller is configured to determine characteristics of an unwanted noise. The unwanted noise originates from a source external to the vehicle. The electronic controller is also configured to determine an inverted noise based on the characteristics of the unwanted noise. The electronic controller is also configured to project the inverted noise. The projected inverted noise destructively interferes with the unwanted noise. The electronic controller is also configured to receive a residual noise via an error microphone. The error microphone is configured to generate a signal based on the received residual noise.

In another exemplary embodiment, the electronic controller is further configured to receive vehicle-to-vehicle communication from a neighboring vehicle. The unwanted noise originates from the neighboring vehicle. The characteristics of the unwanted noise are determined based on the received vehicle-to-vehicle communication and based on the signal from the error microphone.

In another exemplary embodiment, the received vehicle-to-vehicle communication includes at least one of an engine revolutions-per-minute of the neighboring vehicle, a position of the neighboring vehicle, a velocity of the neighboring vehicle, and an identifier of the neighboring vehicle.

In another exemplary embodiment, the electronic controller is further configured to receive laser-detection-and-ranging information, camera information, or radar information about a neighboring vehicle. The unwanted noise originates from the neighboring vehicle, and the characteristics of the unwanted noise are determined based on the signal from the error microphone and based on the received laser-detection-and-ranging information, camera information, or radar information.

In another exemplary embodiment, the determining the inverted noise includes determining a corresponding internal noise that results from the characteristics of the unwanted noise via a reference equalizer.

In another exemplary embodiment, the reference equalizer is configured to perform filtering to correct for a low-frequency transfer function between an external object and an internal reference point.

In another exemplary embodiment, the determining the inverted noise includes determining the inverted noise using a digital filter.

In another exemplary embodiment, the determining the inverted noise includes determining the inverted noise using an adaptive algorithm.

In another exemplary embodiment, the received vehicle-to-vehicle communication is input into a sync estimation processor, and the sync estimation processor is configured to generate a synchronization signal based on the received vehicle-to-vehicle communication. The received vehicle-to-vehicle communication is input into a reference equalizer.

In another exemplary embodiment, the signal of the error microphone is input into a sync estimation processor, and the sync estimation processor is configured to generate a synchronization signal based on the signal of the error microphone. The received laser-detection-and-ranging information, camera information, or radar information is input into a reference equalizer.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

The following description is merely exemplary in nature and is not intended to limit the present disclosure, its application or uses. As used herein, the term module refers to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
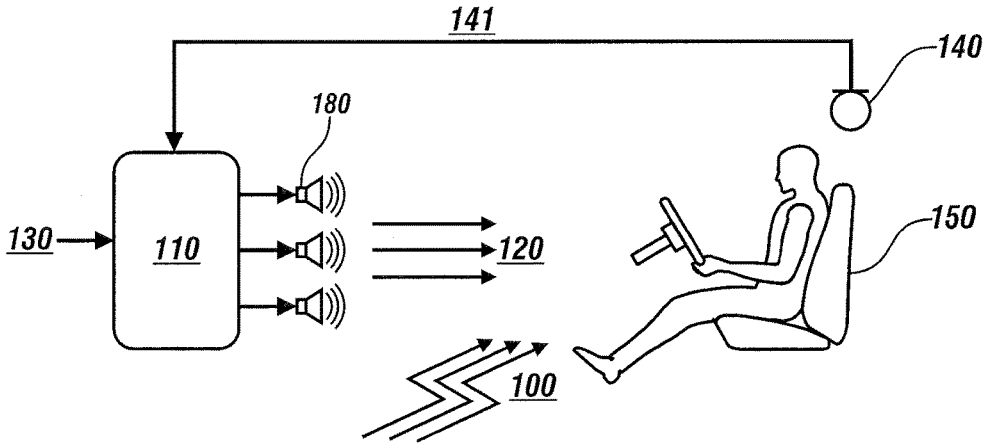
FIG. 1 illustrates a current system for actively controlling unwanted noise that originates from a vehicle's own engine.

FIG. 1 illustrates a current system for actively controlling unwanted noise that originates from a vehicle's own engine. Unwanted engine noise 100 can emanate from a vehicle's own operating engine. The unwanted engine noise 100 can be heard by a passenger/driver 150 within the vehicle cabin of the vehicle. Active noise control system 110 can be configured to generate an inverted noise 120 based at least on a received synchronization signal 130. The synchronization signal can be based at least on a determined revolution-per-minute of the operating engine. The inverted noise 120 reduces the unwanted engine noise 100 by destructively interfering with, and effectively cancelling out, the unwanted engine noise 100. Error microphone 140 is configured to receive any residual noise that can be detected within the vehicle cabin. Error microphone 140 can then transmit an input 141 (based on the detected residual noise) to active noise control system 110. The input 141 from error microphone 140 can be used to modify the inverted noise 120 that is generated in order to more effectively cancel out the unwanted engine noise 100. Speakers 180 project the inverted noise 120 within the vehicle cabin of the passenger/driver 150.

Figure 2:
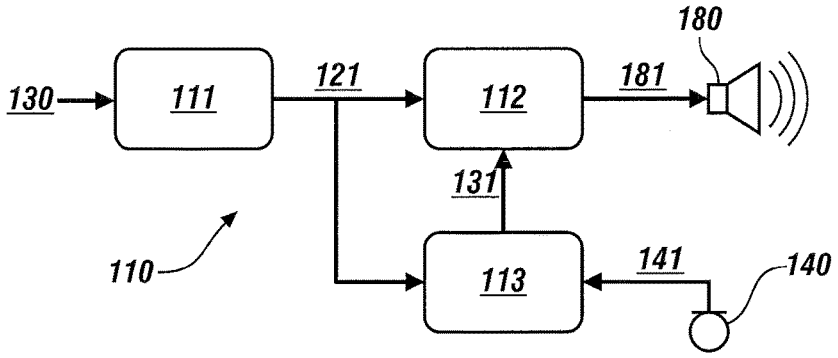
FIG. 2 illustrates an example active noise control system of the current system for actively controlling the unwanted noise.

FIG. 2 illustrates an example active noise control system of the current system for actively controlling the unwanted noise. As described above, active noise control system 110 receives a synchronization signal 130 that is used to generate a reference signal 121 via reference signal generator 111. The generated reference signal 121 is then transmitted to digital filter 112 and to an adaptive algorithm device 113. Adaptive algorithm device 113 determines an adaptive/corrective signal 131 based on the received reference signal 121 and based on the residual noise input 141 that is received via error microphone 140. Digital filter 112 can then transmit an inverted noise signal 181 to be projected by speakers 180 as the inverted noise.

Figure 3:
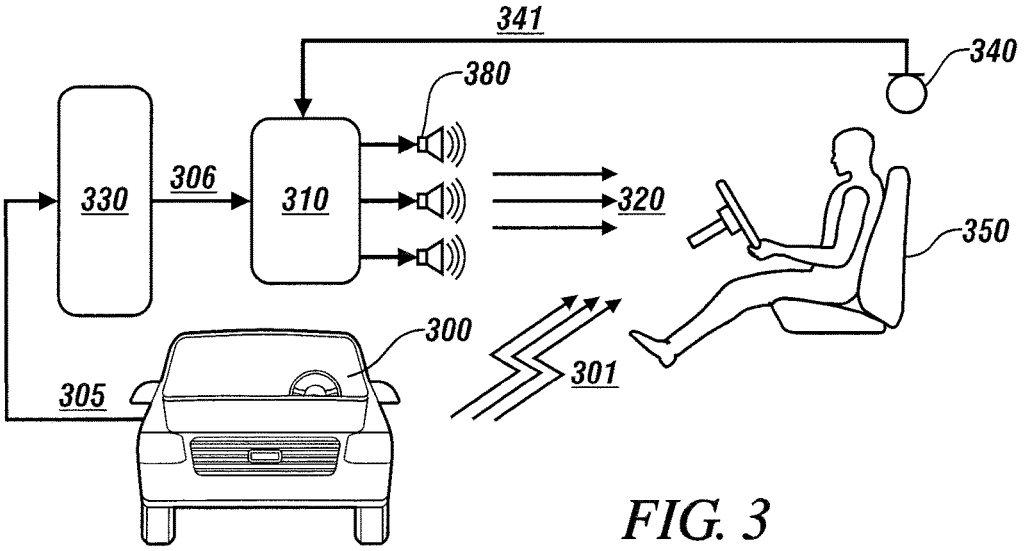
FIG. 3 illustrates a system that uses vehicle-to-vehicle communication to perform active noise control in accordance with one or more embodiments.

FIG. 3 illustrates a system that uses vehicle-to-vehicle communication to perform active noise control in accordance with one or more embodiments. One or more embodiments is directed to a method for cancelling external noise 301 that is present within a vehicle cabin that originates from a source that is external to the present vehicle. The external source can be a neighboring vehicle 300, for example. With one or more embodiments, the neighboring vehicle 300 can be configured to transmit vehicle-to-vehicle (V2V) communication 305 to the present vehicle (where a driver/passenger 350 is within the present vehicle). For example, neighboring vehicle 300 can be configured to transmit V2V communication 305 to a receiving V2V layer 330 of the present vehicle. The V2V communication 305 can include information 306 that reflects characteristics of neighboring vehicle 300 such as, for example, a revolutions per minute (RPM) of an operating engine of neighboring vehicle 300, a position of the neighboring vehicle 300, a velocity of the neighboring vehicle 300, and/or a vehicle identification number (#VIN) of neighboring vehicle 300. V2V layer 330 transmits this information 306 to active noise control system 310. Active noise control system 310 can then generate inverted noise 320 to reduce external noise 301. Speakers 380 can project the inverted noise 320 within the vehicle cabin of passenger/driver 350. Error microphone 340 is configured to receive any residual noise within the vehicle cabin. Error microphone 340 can transmit an input 341 to active noise control system 310 based at least on the received residual noise. The input transmitted by error microphone 340 can be used to modify the inverted noise 320 that is generated in order to more effectively cancel out the unwanted external noise 301.

Figure 4:
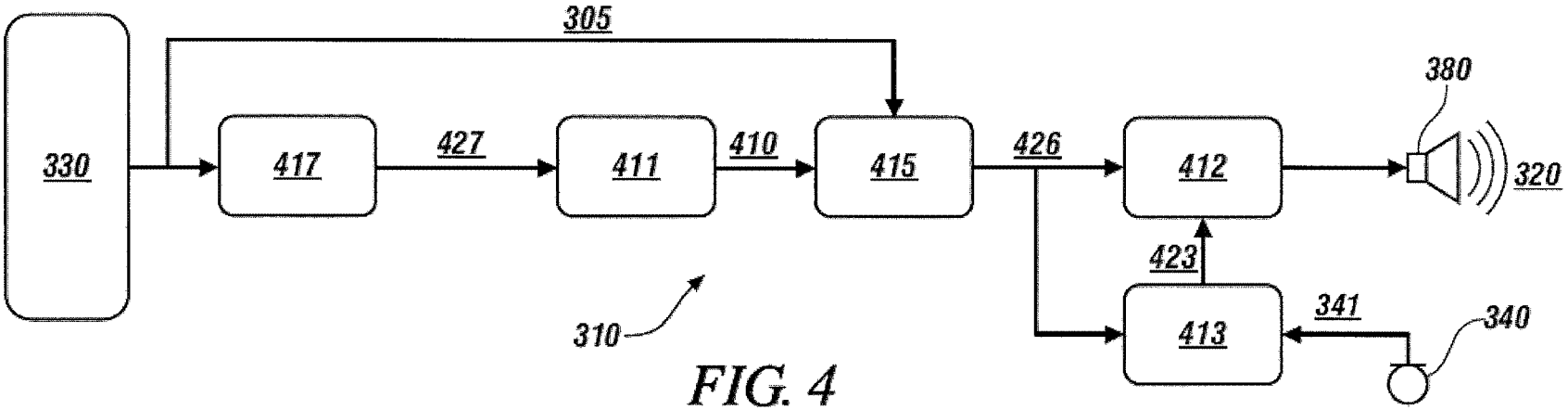
FIG. 4 illustrates an example active noise control system that uses vehicle-to-vehicle communication to perform active noise control in accordance with one or more embodiments.

FIG. 4 illustrates an example active noise control system that uses vehicle-to-vehicle communication to perform active noise control in accordance with one or more embodiments. As described above, V2V layer 330 can receive V2V information 305 about another neighboring vehicle 300. V2V layer 330 can be configured to transmit V2V information 305 to sync estimator 417 and to a reference equalizer 415. Sync estimator 417 can generate a synchronization signal 427 based on the V2V information 305.

Sync estimator 417 can be configured to send a synchronization signal 427 to reference signal generator 411. The synchronization signal 427 can be based on an RPM of the neighboring vehicle and/or a Doppler-shifted RPM (using a relative speed). Reference signal generator 411 can then generate and transmit a reference signal 410 to reference equalizer 415.

Reference equalizer 415 is configured to determine a correct corresponding internal noise that results from the external noise. Specifically, reference equalizer 415 is configured to perform filtering to correct for a low-frequency transfer function between an external object and an internal reference point. Active noise control (ANC) can compensate for, or can take account of, a transfer function between a noise source (such as from an engine of the neighboring vehicle, for example) and a microphone. An external noise can depend on location as well as on other factors. As such, one or more embodiments can estimate the external noise and can provide the external noise as an input to the active noise control system so such that the active noise control system encounters a fixed transfer function. One or more embodiments can use low frequencies (<200 Hz) of the external noise. Reference equalizer 415 is also configured to filter parameters depending on a (quantized) relative position. In one or more embodiments, a position/velocity of the source of external noise 301 can be based on global positioning system (GPS) parameters (which reflect the position/velocity of the source) that are transmitted/received via V2V communication. With one or more embodiments, a filter of reference equalizer 415 can be pre-trained for a number of relative positions of sources of external noise.

Reference equalizer 415 can be configured to send a reference equalizer signal 426 to digital filter 412 and to an adaptive algorithm device 413. Adaptive algorithm device 413 can be configured to determine a corrective signal 423 based on the received reference equalizer signal 426 and based on the residual noise 341 that is detected via error microphone 340. Digital filter 412 can then generate the inverted noise 320 to be projected by speakers 380.

Figure 5:
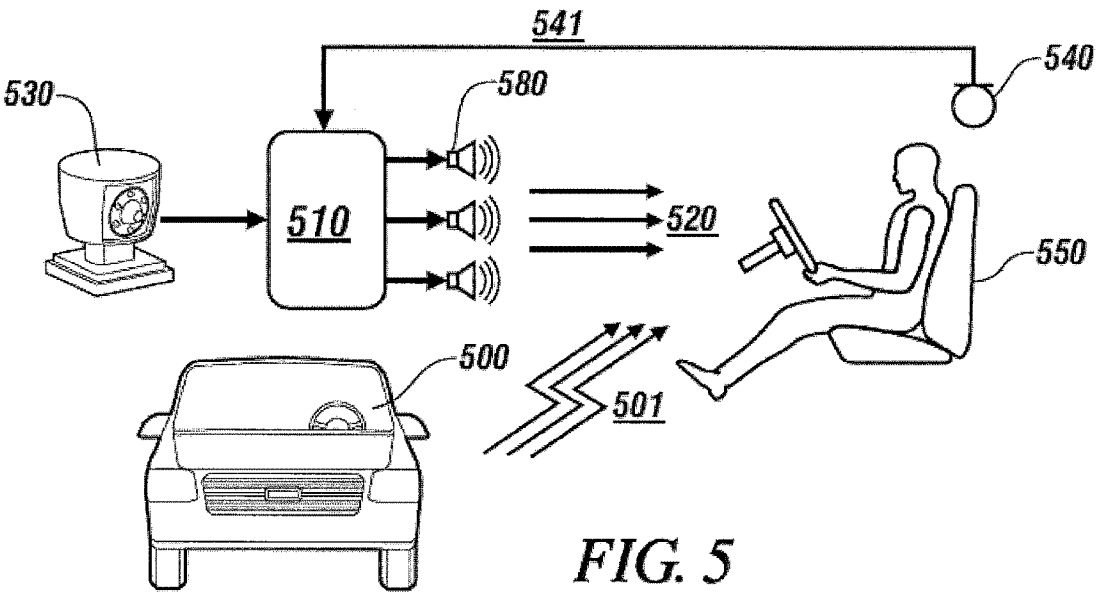
FIG. 5 illustrates a system that uses autonomous sensors to perform active noise control in accordance with one or more embodiments.

FIG. 5 illustrates a system that uses autonomous sensors to perform active noise control in accordance with one or more embodiments. External noise 501 originates from a source that is external to the present vehicle. As described above, the external source can be a neighboring vehicle 500, for example. The present vehicle (within which passenger/driver 550 is seated) can include an autonomous sensor 530 and an active noise control system 510. The autonomous sensor 530 can be a light detection and ranging (LIDAR) sensor, radar sensor, and/or a camera. Sensor 530 can be configured to determine information regarding the neighboring vehicle 500. The sensor information can include information that reflects neighboring vehicle 500 such as, for example, a position of neighboring vehicle 500, a velocity of the neighboring vehicle 500, and/or a vehicle type. Sensor 530 can then transmit the sensor information to active noise control system 510. Active noise control system 510 can then generate inverted noise 520 that cancels out external noise 501. Speakers 580 can project inverted noise 520 towards passenger/driver 550. Error microphone 540 can be configured to receive any residual noise that is detectable within the vehicle cabin of passenger/driver 550. Error microphone 540 can transmit an input 541 to active noise control system 510 based at least on the received residual noise. The input 541 from error microphone 540 can be used to modify the generated inverted noise 520 in order to more effectively cancel out the unwanted noise 501.

Figure 6:
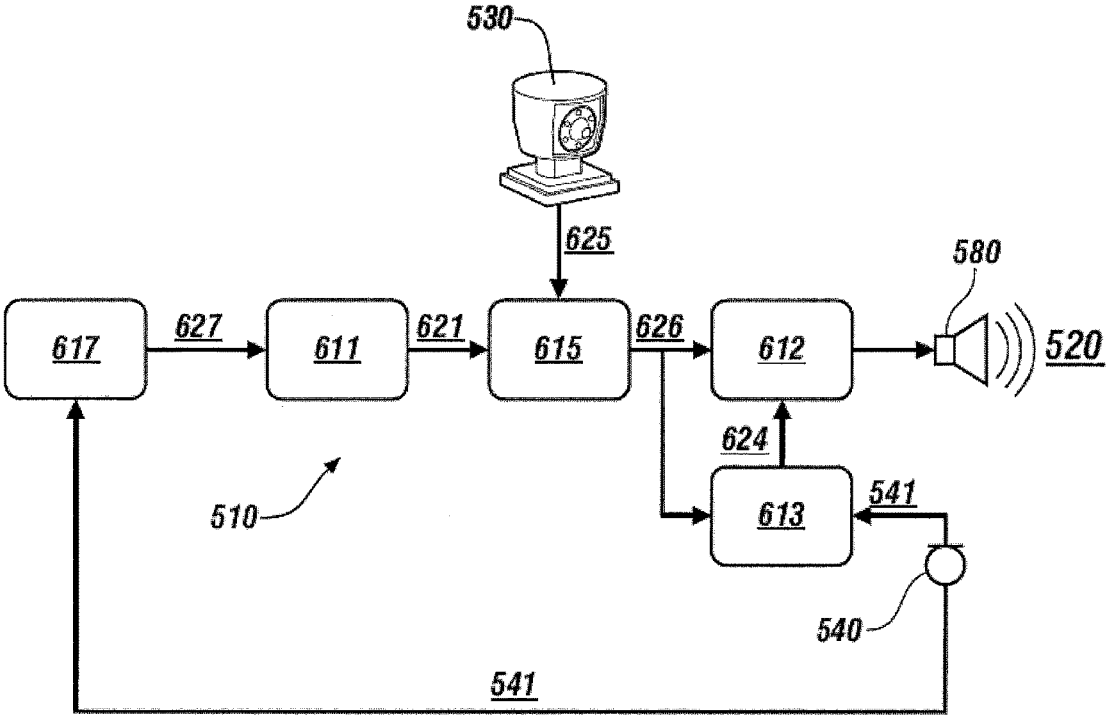
FIG. 6 illustrates an example active noise control system that uses autonomous sensors to perform active noise control in accordance with one or more embodiments.

FIG. 6 illustrates an example active noise control system that uses autonomous sensors to perform active noise control in accordance with one or more embodiments. Sync estimator device 617 generates a synchronization signal 627 based on sound input 541 that is received from one or more microphones (such as microphone 540, for example). One or more embodiments can estimate an engine RPM of a neighboring vehicle (from which an external noise originates) based on harmonics that are detected within a microphone signal. Sync estimator device 617 can transmit the synchronization signal 627 to reference signal generator 611. Reference signal generator 611 can then generate and transmit a reference signal 621 to reference equalizer 615. A sensor 530 can also send sensor information 625 to reference equalizer 615. As described above, ANC can compensate for, or can take account of, a transfer function between a noise source (such as from the engine of a neighboring vehicle, for example) and a microphone. An external noise can depend on location as well as on other factors. As such, one or more embodiments can estimate the external noise and can provide the external noise as an input into an active noise control system so that the active noise control system encounters a fixed transfer function. One or more embodiments can use low frequencies (<200 Hz) of the external noise.

Reference equalizer 615 can be configured to send a reference equalizer signal 626 (based on a received reference signal 621 and/or a sensor information 625) to digital filter 612 and to an adaptive algorithm device 613. Adaptive algorithm device 613 determines a corrective signal 624 based on the received reference equalizer signal 626 and based on the residual noise input 541 that is received via error microphone 540. Digital filter 612 can then generate the inverted noise 520 to be projected by speakers 580.

Figure 7:
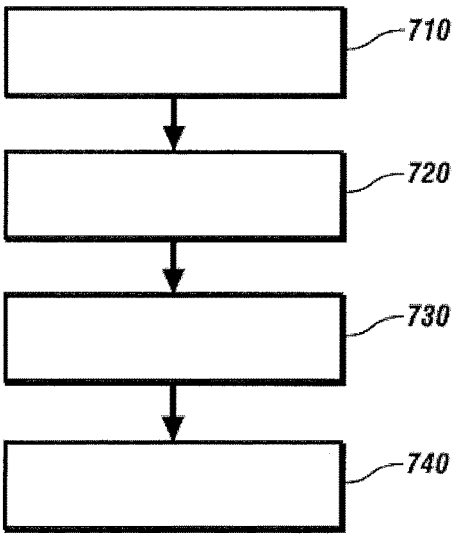
FIG. 7 depicts a flowchart of a method in accordance with one or more embodiments.

FIG. 7 depicts a flowchart of a method in accordance with one or more embodiments. The method of FIG. 7 can be performed in order to control noise originating from a source external to a vehicle. The method can include, at block 710, determining, by an active noise controller of a vehicle, characteristics of an unwanted noise. The unwanted noise originates from a source external to the vehicle. The method also includes, at block 720, determining an inverted noise based on the characteristics of the unwanted noise. The method also includes, at block 730, projecting the inverted noise. The projected inverted noise destructively interferes with the unwanted noise. The method also includes, at block 740, receiving a residual noise via an error microphone. The error microphone is configured to generate a signal based on the received residual noise.

Figure 8:
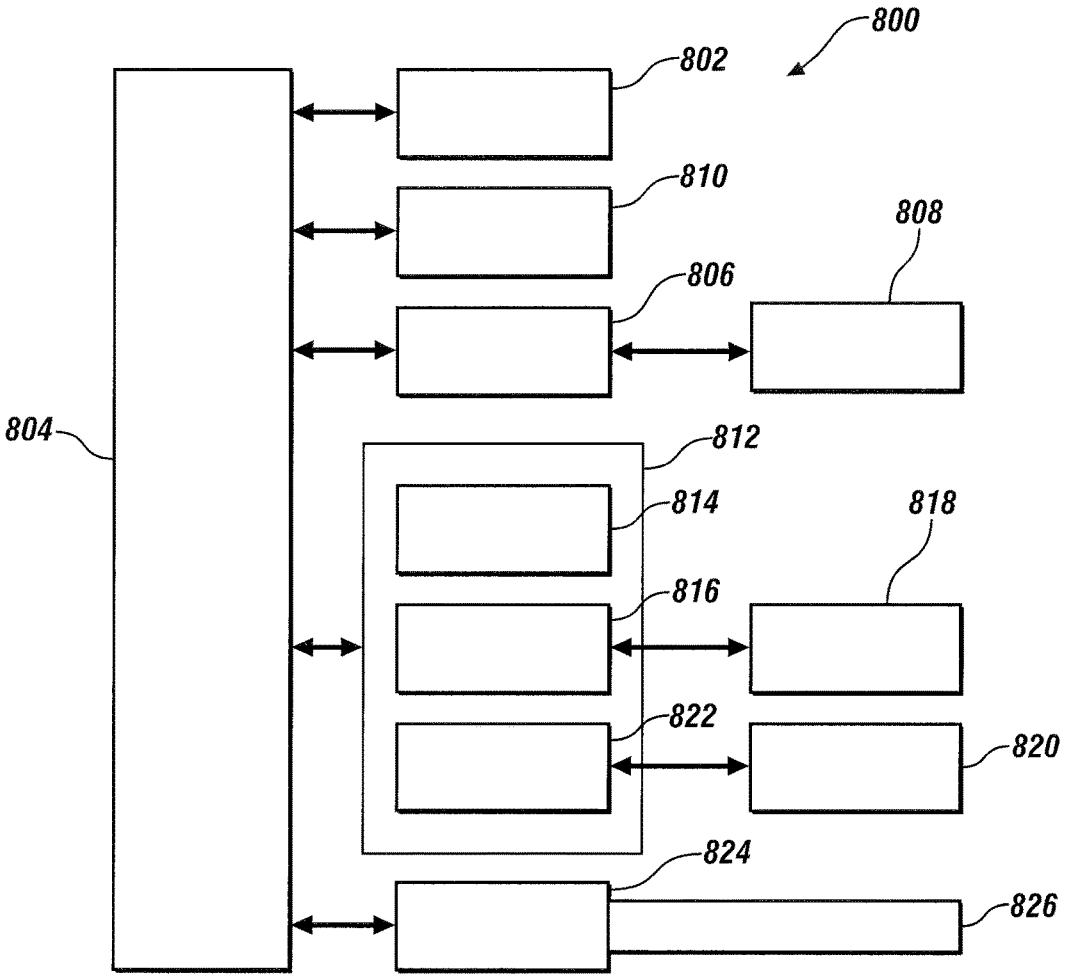
FIG. 8 depicts a high-level block diagram of a computing system, which can be used to implement one or more embodiments.

FIG. 8 depicts a high-level block diagram of a computing system 800, which can be used to implement one or more embodiments. Computing system 800 can correspond to, at least, a system that is configured to perform active noise control, as described above, for example. The active noise control system can be a part of an embedded system of electronics within a vehicle. With one or more embodiments, computing system 800 can correspond to an electronic control unit (ECU) of a vehicle. Computing system 800 can be used to implement hardware components of systems capable of performing methods described herein. Although one exemplary computing system 800 is shown, computing system 800 includes a communication path 826, which connects computing system 800 to additional systems (not depicted). Computing system 800 and additional system are in communication via communication path 826, e.g., to communicate data between them.

Computing system 800 includes one or more processors, such as processor 802. Processor 802 is connected to a communication infrastructure 804 (e.g., a communications bus, cross-over bar, or network). Computing system 800 can include a display interface 806 that forwards graphics, textual content, and other data from communication infrastructure 804 (or from a frame buffer not shown) for display on a display unit 808. Display unit 808 can correspond to at least a portion of a dashboard of a vehicle, for example. Computing system 800 also includes a main memory 810, preferably random access memory (RAM), and can also include a secondary memory 812. There also can be one or more disk drives 814 contained within secondary memory 812. Removable storage drive 816 reads from and/or writes to a removable storage unit 818. As will be appreciated, removable storage unit 818 includes a computer-readable medium having stored therein computer software and/or data.

In alternative embodiments, secondary memory 812 can include other similar means for allowing computer programs or other instructions to be loaded into the computing system. Such means can include, for example, a removable storage unit 820 and an interface 822.

In the present description, the terms "computer program medium," "computer usable medium," and "computer-readable medium" are used to refer to media such as main memory 810 and secondary memory 812, removable storage drive 816, and a disk installed in disk drive 814. Computer programs (also called computer control logic) are stored in main memory 810 and/or secondary memory 812. Computer programs also can be received via communications interface 824. Such computer programs, when run, enable the computing system to perform the features discussed herein. In particular, the computer programs, when run, enable processor 802 to perform the features of the computing system. Accordingly, such computer programs represent controllers of the computing system. Thus it can be seen from the forgoing detailed description that one or more embodiments provide technical benefits and advantages.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A method, the method comprising:

determining, by an active noise controller of a vehicle, characteristics of an unwanted noise, wherein the unwanted noise originates from a source external to the vehicle;

determining an inverted noise based on the characteristics of the unwanted noise;

projecting the inverted noise, wherein the projected inverted noise destructively interferes with the unwanted noise;

receiving a residual noise via an error microphone, wherein the error microphone is configured to generate a signal based on the received residual noise; and receiving vehicle-to-vehicle communication that is transmitted by a neighboring vehicle, wherein the transmitted vehicle-to-vehicle communication comprises at least one of an engine revolutions-per-minute of the neighboring vehicle, a position of the neighboring vehicle, and a velocity of the neighboring vehicle, the unwanted noise originates from the neighboring vehicle, and the characteristics of the unwanted noise are determined based on the received vehicle-to-vehicle communication and based on the signal from the error microphone.

2. The method of claim 1, wherein the received vehicle-to-vehicle communication comprises an identifier of the neighboring vehicle.

3. The method of claim 1, further comprising receiving laser-detection-and-ranging information, camera information, or radar information about the neighboring vehicle, wherein the unwanted noise originates from the neighboring vehicle, and the characteristics of the unwanted noise are determined based on the signal from the error microphone and based on the received laser-detection-and-ranging information, camera information, or radar information.

4. The method of claim 1, wherein the determining the inverted noise comprises determining a corresponding internal noise that results from the characteristics of the unwanted noise via a reference equalizer.

5. The method of claim 4, wherein the reference equalizer is configured to perform filtering to correct for a low-frequency transfer function between an external object and an internal reference point.

6. The method of claim 1, wherein the determining the inverted noise comprises determining the inverted noise using a digital filter.

7. The method of claim 1, wherein the determining the inverted noise comprises determining the inverted noise using an adaptive algorithm.

8. The method of claim 1, wherein the received vehicle-to-vehicle communication is input into a sync estimation processor, and the sync estimation processor is configured to generate a synchronization signal based on the received vehicle-to-vehicle communication, and the received vehicle-to-vehicle communication is input into a reference equalizer.

9. The method of claim 3, wherein the signal of the error microphone is input into a sync estimation processor, and the sync estimation processor is configured to generate a synchronization signal based on the signal of the error microphone, and the received laser-detection-and-ranging information, camera information, or radar information is input into a reference equalizer.

10. A system within a vehicle, comprising:

an electronic controller configured to:

determine characteristics of an unwanted noise, wherein the unwanted noise originates from a source external to the vehicle;

determine an inverted noise based on the characteristics of the unwanted noise;

project the inverted noise, wherein the projected inverted noise destructively interferes with the unwanted noise;

receive a residual noise via an error microphone, wherein the error microphone is configured to generate a signal based on the received residual noise; and receive vehicle-to-vehicle communication that is transmitted by a neighboring vehicle, wherein the transmitted vehicle-to-vehicle communication comprises at least one of an engine revolutions-per-minute of the neighboring vehicle, a position of the neighboring vehicle, and a velocity of the neighboring vehicle, the unwanted noise originates from the neighboring vehicle, and the characteristics of the unwanted noise are determined based on the received vehicle-to-vehicle communication and based on the signal from the error microphone.

11. The system of claim 10, wherein the received vehicle-to-vehicle communication comprises an identifier of the neighboring vehicle.

12. The system of claim 10, wherein the electronic controller is further configured to receive laser-detection-and-ranging information, camera information, or radar information about the neighboring vehicle, the unwanted noise originates from the neighboring vehicle, and the characteristics of the unwanted noise are determined based on the signal from the error microphone and based on the received laser-detection-and-ranging information, camera information, or radar information.

13. The system of claim 10, wherein the determining the inverted noise comprises determining a corresponding internal noise that results from the characteristics of the unwanted noise via a reference equalizer.

14. The system of claim 13, wherein the reference equalizer is configured to perform filtering to correct for a low-frequency transfer function between an external object and an internal reference point.

15. The system of claim 10, wherein the determining the inverted noise comprises determining the inverted noise using a digital filter.

16. The system of claim 10, wherein the determining the inverted noise comprises determining the inverted noise using an adaptive algorithm.

17. The system of claim 10, wherein the received vehicle-to-vehicle communication is input into a sync estimation processor, and the sync estimation processor is configured to generate a synchronization signal based on the received vehicle-to-vehicle communication, and the received vehicle-to-vehicle communication is input into a reference equalizer.

18. The system of claim 12, wherein the signal of the error microphone is input into a sync estimation processor, and the sync estimation processor is configured to generate a synchronization signal based on the signal of the error microphone, and the received laser-detection-and-ranging information, camera information, or radar information is input into a reference equalizer.

* * * * *